US005540026A

United States Patent [19]

Gartland

[11] Patent Number: 5,540,026

[45] Date of Patent: Jul. 30, 1996

[54] PANEL AND A METHOD FOR PRODUCING THE PANEL

[75] Inventor: Matthew Gartland, Mullingar, Ireland

[73] Assignee: Rivdal Developments Limited, County Westmeath, Ireland

[21] Appl. No.: 325,214

[22] PCT Filed: Apr. 23, 1993

[86] PCT No.: PCT/IE93/00023

§ 371 Date: Oct. 21, 1994

§ 102(e) Date: Oct. 21, 1994

[87] PCT Pub. No.: WO93/22115

PCT Pub. Date: Nov. 11, 1993

[30] Foreign Application Priority Data

Apr. 23, 1992 [IE] Ireland ..... 1309/92

[51] Int. Cl.[6] ..... E06B 3/70

[52] U.S. Cl. ..... 52/455; 52/457; 52/313; 52/784.13; 156/245

[58] Field of Search ..... 52/455, 456, 457, 52/458, 311.1, 311.2, 312, 313, 784.1, 784.13, 745.15, 314, 316, 309.9, 309.15, 314; 156/245, 212, 213, 214

[56] References Cited

U.S. PATENT DOCUMENTS

| | | | |
|---|---|---|---|
| 3,731,444 | 5/1973 | Tobin | 52/455 X |
| 4,008,551 | 2/1977 | MacDonald et al. | 52/312 X |
| 4,702,054 | 10/1987 | Turner | 52/455 X |
| 4,704,834 | 11/1987 | Turner | 52/312 X |
| 4,706,431 | 11/1987 | Corvese | 52/312 X |
| 5,087,311 | 2/1992 | Elliott et al. | 156/245 X |
| 5,226,997 | 7/1993 | Vallier | 156/245 X |

FOREIGN PATENT DOCUMENTS

| | | |
|---|---|---|
| 0277775 | 8/1988 | European Pat. Off. . |
| 2119268 | 8/1972 | France . |
| 3423252 | 1/1986 | Germany . |
| 3516645 | 11/1986 | Germany . |
| 2254872 | 10/1992 | United Kingdom . |

*Primary Examiner*—Kenneth J. Dorner
*Assistant Examiner*—Kien T. Nguyen
*Attorney, Agent, or Firm*—Lowe, Price, LeBlanc & Becker

[57] ABSTRACT

A panel (1) comprising a front surface (2) shaped to simulate a framed-up panel is manufactured by forming a main panel member (4) from a main substrate (7) laminated with a main veneer sheet (10). A front surface (5) of the main panel member (4) is formed and shaped to simulate a pair of stiles (12) and an infill panel (14) and to define rail receiving surfaces (15) at opposite ends of the infill panel (14). Rails (16) each formed from a secondary substrate (20) laminated with a secondary veneer sheet (24) are bonded to the rail receiving surfaces (15) and join the stiles (12).

23 Claims, 7 Drawing Sheets

PANEL AND A METHOD FOR PRODUCING THE PANEL

The present invention relates to a panel and to a method for producing the panel having first and second opposite major surfaces, the first major surface simulating a framed-up panel of the type comprising an infill panel and a pair of spaced apart stiles joined by a pair of spaced apart rails which together extend around the infill panel.

Wood panels of the type which are referred to as framed-up panels are used extensively, for example, as apartment doors, doors for cabinets, cupboards, panels for coffins, panelling for walls, ceilings and the like. In general, such panels comprise a frame formed by spaced apart vertical stiles joined by spaced apart horizontal rails which together surround an infill panel or a plurality of infill panels. Traditionally, the stiles, rails and infill panel have been constructed separately from hardwood, such as for example, mahogany, oak and the like and then assembled. However, due to the relatively high cost of such woods, such panels are commonly constructed wholly or partly from a substrate of low grade wood, wood particles or chips laminated with a veneer sheet. For example, the infill panel may comprise a substrate of a low grade wood, for example chipboard, fibre board of high, medium or low density, or other suitable substrate laminated with a veneer sheet of hardwood, softwood, synthetic foil or the like. The stiles and rails may likewise be constructed from a similar or different type of substrate laminated with a similar or different veneer sheet, or may be of hardwood. While such framed-up panels result in a reduction in the material cost, nonetheless the labour cost required in assembling such panels is relatively high.

It is known to produce a framed-up panel using a single sheet of low grade wood as a substrate laminated with a veneer sheet of hardwood, softwood or synthetic foil. Typically the substrate is formed from a sheet of chipboard, medium density fibre board or the like. One surface of the substrate is machined to form simulated stiles, rails and an infill panel. If desired the infill panel may simulate a raised infill panel. A single veneer sheet is laminated to the formed surface by compression moulding the veneer sheet to substrate to follow the contours of the formed surface. Alternatively, in cases where the depth of the surface of the infill panel below the surface of the stiles and rails is relatively shallow, the stiles, rails and infill panel may be formed by embossing during lamination of the veneer sheet to the substrate. In such cases, machining of the substrate prior to lamination with the veneer sheet is avoided. Framed-up panels formed in this way have been of only limited success, irrespective of whether a surface of the substrate has been machined to form the stiles, rails and infill panel prior to lamination of the veneer sheet, or not. Such panels suffer from two major disadvantages. Firstly, where the veneer sheet is of timber or other sheet material having a grain pattern, since a single veneer sheet is laminated to the substrate, the grain of the veneer sheet runs in a single direction only over the entire panel. Accordingly, where the grain runs parallel to the stiles, the grain must run transversely of the rails or vice versa. This is clearly undesirable, since the panel so formed lacks a look of authenticity. A second major disadvantage of such panels is that the maximum depth between the surface of the infill panel and the surface of the stiles and rails is limited. Wood veneer sheets while they are relatively malleable and stretchable in one direction, namely, in a direction transversely of the grain, their malleability and stretchability is relatively poor in a direction parallel to the grain. This seriously limits the depth to which the surface of the infill panel can be formed relative to the surface of the stiles and rails. Where the grain of the wood veneer runs transversely across the rails, if the depth of the surface of the infill panel below the surface of the rails is too great, in other words, if the steps between the surface of the infill panel and the surface of the rails are too great, the veneer sheet ruptures on being bent transversely across the grain to accommodate the steps between the infill panel and the respective rails. This is a particularly serious problem where the side edge profile of the rails adjacent the infill panel is relatively sharp and forms a relatively shape angle and a deep step between the infill panel surface and the surface of the rails. Accordingly, as well as limiting the depth between the surface of the infill panel and the surface of the rails or stiles as the case may be, the side edge profile of the rails and stiles which can be accommodated in such panels is limited.

A method for producing a framed-up panel which attempts to overcome these problems is disclosed in European Patent Specification No. 0,277,775A. The panel is formed from a single substrate of low grade wood, typically, chipboard. One surface of the substrate is machined to form a pair of spaced apart stiles joined by rails which surround an infill panel. The substrate is laminated with a number of separate veneer sheets. One veneer sheet is laminated to the portion of the substrate defining the infill panel. Separate veneer sheets are laminated to the portions of the substrate defining the stiles, while further separate veneer sheets are laminated to the portions of the substrate defining the rails. In this way, it is possible to arrange the grain of the veneer sheets to extend parallel to the rails and stiles. Furthermore, this method of constructing a panel also facilitates a greater depth of the surface of the infill panel relative to the surface of the rails and stiles. A disadvantage of this method for forming a panel is that a relatively high degree of precision is required to shape and position the veneer sheets on the substrate, and this tends to result in a panel of relatively high cost, and with a limited field of use.

An alternative method for constructing a framed-up panel which also attempts to overcome the problems of known methods is disclosed in German Patent Specification No. 34 23 252. The panel comprises a substrate of chipboard which is laminated with a first veneer sheet which covers the entire surface of the substrate which is to simulate the framed-up panel surface. The grain of the veneer sheet runs parallel to the stiles. Two transverse veneer sheets are laminated on top of the first veneer sheet at opposite ends of the panel and are located in positions where rails are to be formed. The grain of the transverse veneer sheets runs parallel to the respective rails. The veneer sheets and the substrate are laminated together, and the simulated stiles, rails and infill panel are formed by embossing during lamination. The method for forming a panel disclosed in this German Specification while it enables a panel to be formed with the grain of the veneer sheets running parallel to the respective stiles and rails, it does not facilitate the formation of a framed-up panel with a relatively deep step between the infill panel surface and the surface of the stiles and rails. Furthermore, because of the need to position and orient a number of veneer sheets on the substrate prior to lamination thereof, the production of panels using this method tends to be relatively tedious and time consuming, thus leading to a relatively high cost panel, which also has a limited field of use.

There is therefore a need for a panel with at least one surface which simulates a framed-up panel and a method for producing such a panel which overcomes the problems of known panels and methods.

It is an object of the invention to provide a method for producing a panel having at least one major surface which simulates a framed-up panel and which overcomes the problems of known methods. It is also an object of the invention to provide such a panel. In particular, it is an object of the invention to provide a method for producing a panel having at least one major surface which simulates a framed-up panel from a substrate and a veneer sheet, whereby the method accommodates the formation of a panel with a reasonable depth between the surface of the stiles and rails on the one hand and the surface of the infill panel adjacent the stiles and rails on the other hand without the danger of rupturing of the veneer sheet adjacent a profiled step or edge surface between the infill panel and the stiles and rails. Further, it is an object of the invention to provide a method for producing such a panel in which a grain pattern on the stiles and rails runs parallel to the respective stiles and rails. A further object of the invention is to provide a panel produced according to the method.

The invention overcomes the problems of known methods for producing a panel by virtue of the fact that in accordance with the invention there is provided a method for producing a panel having first and second opposite major surfaces, the first major surface simulating a framed-up panel of the type comprising an infill panel and a pair of spaced apart stiles joined by a pair of spaced apart rails which together extend around the infill panel, wherein the method comprises the steps of providing a main panel member having first and second opposite major surfaces corresponding respectively to the first and second surfaces of the panel, the main panel member being formed from a main substrate having first and second opposite major faces, and a main veneer sheet laminated to the first face of the main substrate for forming the first surface of the main panel member, shaping the first surface of the main panel member to simulate two spaced apart elongated stiles and an infill panel extending between the stiles and to define two spaced apart rail receiving surfaces extending between the stiles adjacent respective opposite ends of the infill panel, and securing two spaced apart elongated rails to the respective rail receiving surfaces, the rails extending between and joining the stiles.

The advantages of the invention are many. The method of the invention facilitates the production of a panel in which at least one major surface of the panel simulates a framed-up panel having stiles, rails and an infill panel. The method of the invention provides two particularly important advantages in that, firstly, the panel may be formed with a reasonable depth between the surface of the stiles and rails and the surface of the infill panel adjacent the stiles and rails, and secondly, the panel may be formed with the grain pattern on the stiles and rails running substantially parallel to the respective stiles and rails. These advantages are achieved by virtue of the fact that the method requires the provision of a main panel member which is formed to simulate the infill panel and stiles only, and the rails are then subsequently secured to the main panel member. Because of this, the rails may be produced from solid timber or from a substrate laminated with a veneer sheet, and in both cases the rails can be provided with the grain pattern of the rails running parallel to the respective rails. Additionally, where each rail comprises a secondary substrate and a secondary veneer sheet, the secondary veneer sheet can be arranged on the substrate so that its direction of malleability and stretchability extends transversely of the rail to facilitate bending of the secondary veneer sheet over and along a side edge surface of the rail adjacent the infill panel.

By virtue of the fact that the main panel member is formed without the rails, in other words, by virtue of the fact that the main panel member is formed with the stiles and infill panels only, the main veneer sheet can be arranged on the main substrate so that its direction of malleability and stretchability is such as to facilitate bending and forming of the main veneer sheet over and along side edge surfaces of the stiles adjacent the infill panel.

A further advantage of the invention is that by virtue of the fact that the main panel member comprises a main substrate and a main veneer sheet the main panel member, and in turn the panel can be formed readily quickly and easily at relatively low cost of production.

Preferably, the first surface of the main panel member is shaped by forming an elongated trough shaped recess in the first surface extending longitudinally from end to end of the main panel member, the recess defining a base which forms the infill panel and the rail receiving surfaces, and the recess defining opposite side walls extending from the base which form respective side edge surfaces of the stiles. By forming the panel in this fashion all the above discussed advantages of the invention are achieved, and in particular, a particularly low cost, economical, simple and easy to preform method is provided.

In one embodiment of the invention portion of the base of the recess is raised or lowered to form an infill panel of corresponding shape. The advantage of this feature of the invention is that it permits formation of an infill panel of any desired shape.

In one embodiment of the invention the main veneer sheet has a longitudinally extending grain pattern, and the main veneer sheet is laminated to the main substrate with the grain pattern extending parallel to the stiles. Where the main veneer sheet is of wood, by virtue of the fact that the grain pattern extends parallel to the stiles the main veneer sheet is malleable and stretchable in a direction transverse of the stiles, and accordingly, bending of the main veneer sheet between the respective stiles and the infill panel is accommodated. Furthermore, the panel has an authentic look.

In another embodiment of the invention each rail has first and second opposite major surfaces, the first surface corresponding to the first surface of the panel, and the second surface being secured to the corresponding rail receiving surface of the main panel member, the method further comprising the steps of forming each rail by providing a secondary substrate having first and second opposite major faces, and laminating a secondary veneer sheet to the first face of the secondary substrate for forming the first surface of the rail. The advantage of this feature of the invention is that it permits a panel of relatively low cost to be produced, since the rail can largely be provided from a relatively low grade timber or from timber waste.

Preferably, the secondary veneer sheet of each rail has a longitudinally extending grain pattern, the secondary veneer sheets being laminated to the respective secondary substrates with the grain pattern extending substantially parallel to the respective rails. The advantage of this feature of the invention is that where the secondary veneer sheet is of wood, the secondary veneer sheet is arranged with its direction of malleability and stretchability extending transversely of each rail, and accordingly, the secondary veneer sheet may be bent over and along a side edge of the rail adjacent the infill panel without danger of rupturing the secondary veneer sheet. Additionally, because the grain of the secondary veneer sheet extends longitudinally of the rail the panel so formed has a look of authenticity.

In one embodiment of the invention a longitudinally extending side edge surface of each rail adjacent the infill panel is shaped to form a transverse profile, which extends longitudinally along the rail. Preferably, the secondary veneer sheet of each rail extends over the side edge surface of the rail to facilitate ease of forming of the rail.

In one embodiment of the invention a side edge surface of each secondary substrate is shaped with a side edge surface profile which roughly forms an outline of the side edge surface profile of the rail, and the secondary veneer sheet is laminated to the secondary substrate after the side edge surface profile has been formed in the secondary substrate. This provides a relatively inexpensive method for producing the panel, and also facilitates a panel to be produced with a reasonable depth between the surface of the stiles and rails and the infill panel surface adjacent the stiles and rails.

In one embodiment of the invention the side edge surface profile of each rail is formed during lamination of the secondary veneer sheet to the secondary substrate. This provides relatively low cost and inexpensive method for producing the panel.

Preferably, the secondary veneer sheet of each rail is laminated to the secondary substrate by compression moulding. Advantageously, each secondary substrate is a one piece substrate formed from a single piece of material. Preferably, the secondary veneer sheet of each rail is formed from a single veneer sheet.

In one embodiment of the invention the main substrate is a one piece substrate formed from a single sheet of material. The advantage of providing the main substrate as a one piece substrate formed from a single sheet of material is that it provides a relatively strong panel, and also provides a relatively inexpensive method for producing the panel.

Advantageously, the first face of the main substrate is shaped to form a rough outline of the first surface of the main panel member. The advantage of this feature of the invention is that it provides a relatively inexpensive method for producing the panel, and it facilitates the provision of a panel with a reasonable depth between the surface of the stiles and rails and the surface of the infill panel adjacent the stiles and rails.

Preferably, the first face of the main substrate is shaped by machining. This is a particularly advantageous method of producing the main panel member.

In one embodiment of the invention the main veneer sheet is laminated to the main substrate after the first face of the main substrate has been shaped.

In another embodiment of the invention the first surface of the main panel member is formed during lamination of the main veneer sheet with the main substrate. Preferably, the main veneer sheet is laminated to the main substrate by compression moulding.

In one embodiment of the invention the first surface of the main panel member defines an intermediate stile receiving surface between the stiles and spaced apart therefrom for receiving an intermediate stile located intermediate and spaced apart from the stiles and extending between and joining the rails, the intermediate stile being secured to the stile receiving surface, respective infill panels being formed between the intermediate stile receiving surface and the respective adjacent stiles. The advantage of this aspect of the invention is that it enables a panel to be produced which is particularly suitable for forming an apartment door.

In another embodiment of the invention the first surface of the main panel member defines an intermediate rail receiving surface between the rail receiving surfaces and spaced apart therefrom for receiving an intermediate rail located intermediate and spaced apart from the rails extending between and joining the stiles, the intermediate rail being secured to the intermediate rail receiving surface, respective infill panels being formed between the intermediate rail receiving surface and the respective adjacent rail receiving surfaces. The advantage of this aspect of the invention is that it enables a panel member to be produced which is particularly suitable for forming an apartment door.

In another embodiment of the invention the side edge surface of each stile adjacent the infill panel is shaped to form a transverse profile, which extends longitudinally along the side edge surface.

In a further embodiment of the invention the profile of the side edge surfaces of the respective stiles and rails may be selected from any one or more of the following profiles, bevelled, curved, convex and concave.

In one embodiment of the invention respective ends of each rail are shaped to accommodate the side edge profile of the adjacent stiles prior to securing the rails to the main panel member.

In another embodiment of the invention the main veneer sheet covers the entire first face of the main substrate. The advantage of this feature of the invention is that it provides relatively low cost and inexpensive method for producing the main panel member and in turn the panel.

Advantageously, the main veneer sheet is formed from a single sheet of veneer.

In one embodiment of the invention each rail receiving surface is co-planar with an adjacent portion of the infill panel surface. The advantage of this feature of the invention is that it facilitates production of the panel member.

In one embodiment of the invention each rail is secured to the main panel member so that the secondary veneer sheet merges with the main veneer sheet to form the first surface of the panel. The advantage of this feature of the invention is that it provides an aesthetically pleasing panel.

Preferably, each rail is secured to the main panel member by bonding.

In one embodiment of the invention the main and secondary substrates may be of similar or different materials, and may be selected from any one or more of the following materials:

any suitable wood or reconstituted wood,
softwood,
hardwood,
chipboard,
oriented strand board,
high density, medium or low density fibre board, and
any composite material.

In another embodiment of the invention the main and secondary veneer sheets may be similar or different and may be matched or otherwise, and may be selected from any one or more of the following types of veneer sheets:

timber veneer sheet of hardwood or softwood,
synthetic foil,
veneer sheet of plastics material which may or may not simulate a grain,
decorative veneer sheet, and
any other suitable veneer sheet.

In a further embodiment of the invention a backing veneer sheet is laminated to the second face of the main substrate to form the second surface of the panel.

In a still further embodiment of the invention the panel defines a peripheral side edge surface extending around the periphery of the panel joining the first and second surfaces, and an edging strip is laminated to the peripheral side edge surface.

Additionally the invention provides a panel having first and second opposite major surfaces, the first major surface simulating a framed-up panel of the type comprising an infill panel and a pair of spaced apart stiles joined by a pair of spaced apart rails which together extend round the infill panel, wherein the panel is formed using the method according to the invention.

Further the invention provides a panel having first and second opposite major surfaces, the first major surface simulating a framed-up panel of the type comprising an infill panel and a pair of spaced apart stiles joined by a pair of spaced apart rails which together extend around the infill panel, wherein the panel comprises a main panel member having first and second opposite major surfaces corresponding respectively to the first and second surfaces of the panel, the main panel member being formed from a main substrate having first and second opposite major faces, and a main veneer sheet laminated to the first face of the main substrate for forming the first surface of the main panel member, the first surface of the main panel member being shaped to simulate two spaced apart elongated stiles and an infill panel extending between the stiles and to define two spaced apart rail receiving surfaces extending between the stiles adjacent respective opposite ends of the infill panel, and two spaced apart elongated rails secured to the respective rail receiving surfaces, the rails extending between and joining the stiles.

Preferably, the first surface of the main panel member is shaped by the formation of an elongated trough shaped recess in the first surface extending longitudinally from end to end of the main panel member, the recess defining a base which forms the infill panel and the rail receiving surfaces, and the recess defining opposite side walls extending from the base which form respective side edge surfaces of the stiles.

In one embodiment of the invention portion of the base of the recess is raised or lowered to form an infill panel of corresponding shape.

In another embodiment of the invention the main veneer sheet is provided with a longitudinally extending grain pattern which extends substantially parallel to the stiles. Advantageously, each rail has first and second opposite major surfaces, the first major surface corresponding to the first surface of the panel, the second major surface being secured to the corresponding rail receiving surface of the main panel member, each rail comprising a secondary substrate having first and second opposite major faces corresponding to the first and second surfaces of the rail, and a secondary veneer sheet laminated to the first face of the secondary substrate for forming the first surface of the rail.

In one embodiment of the invention the secondary veneer sheet of each rail is provided with a longitudinally extending grain pattern, which extends substantially parallel to the rail.

In another embodiment of the invention a longitudinally extending side edge surface of each rail adjacent the infill panel is shaped to form a transverse profile which extends longitudinally along the rail.

Preferably, the secondary substrate of each rail is a one piece substrate formed from a single piece of material.

Advantageously, the secondary veneer sheet of each rail is formed from a single sheet of veneer.

Preferably, the rail is bonded to the main panel member.

In another embodiment of the invention the side edge surface of each stile adjacent the infill panel is shaped to form a transverse profile, which extends longitudinally along the side edge surface.

A further advantage of the invention is that the production of simulated framed-up panels using the method according to the invention is relatively simple and economical. Accordingly, simulated framed-up panels can be produced by mass production techniques relatively simply and economically. Furthermore, such panels which comprise a plurality of infill panels may be provided at relatively low cost. Typical uses for such panels are apartment doors, panels for lining walls, ceilings and the like. The method for producing the panels according to the invention is particularly suitable for extrusion, or direct moulding from chips, fibres, or the like, and where such panels are provided with co-planar infill panels, the main panel member may be formed by extrusion, and a continuous extrusion may be formed which would be cut to length to form a plurality of main panel members. Additionally, the main panel member may be readily easily sanded prior to securing the rails thereto and the rails may also be readily easily sanded prior to securing to the main panel member.

The invention will be more clearly understood from the following description of some preferred embodiments thereof given by way of example only with reference to the accompanying drawings, in which.

Figure 1:
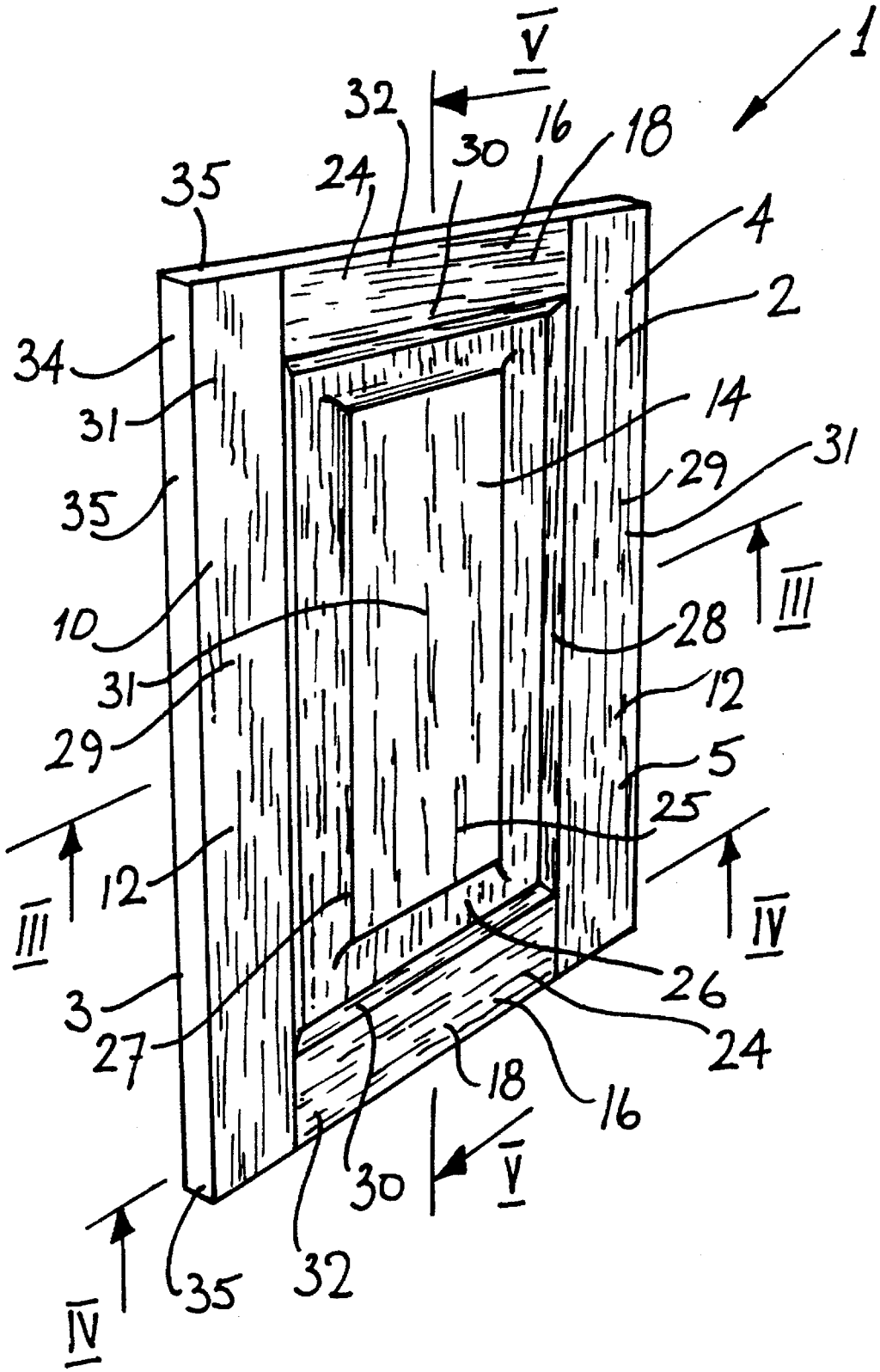
FIG. 1 is a perspective view of a panel according to the invention.
Figure 2:
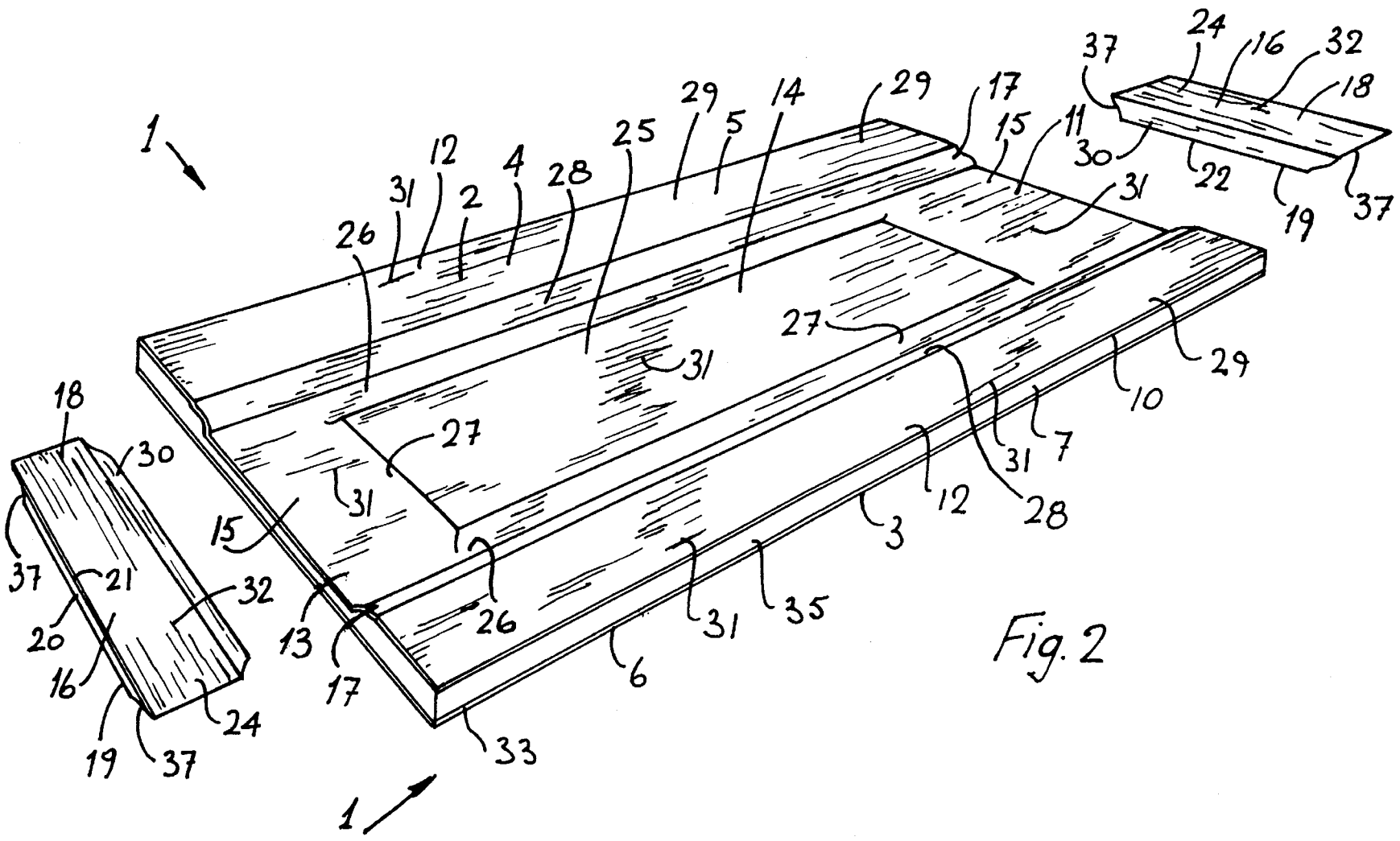
FIG. 2 is an exploded perspective view of the panel of FIG. 1.
Figure 3:
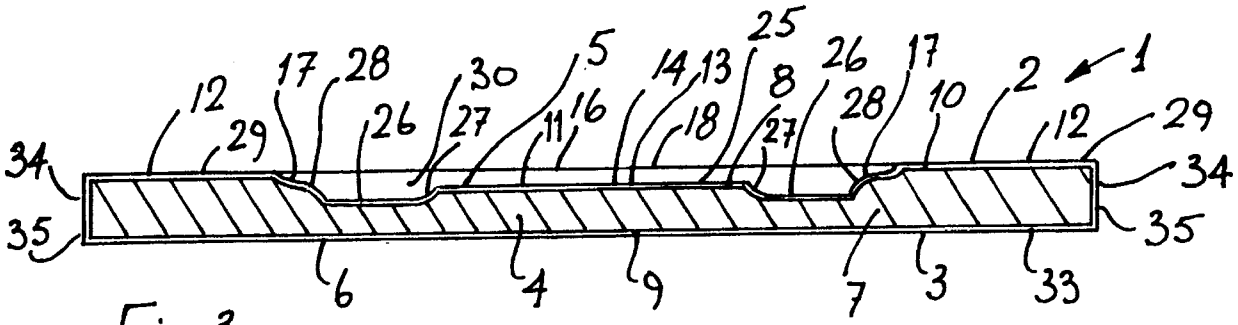
Figure 4:
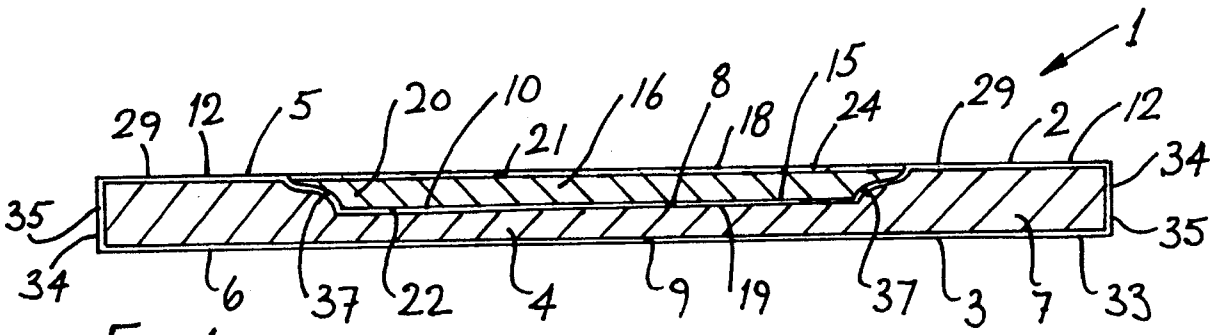
Figure 5:
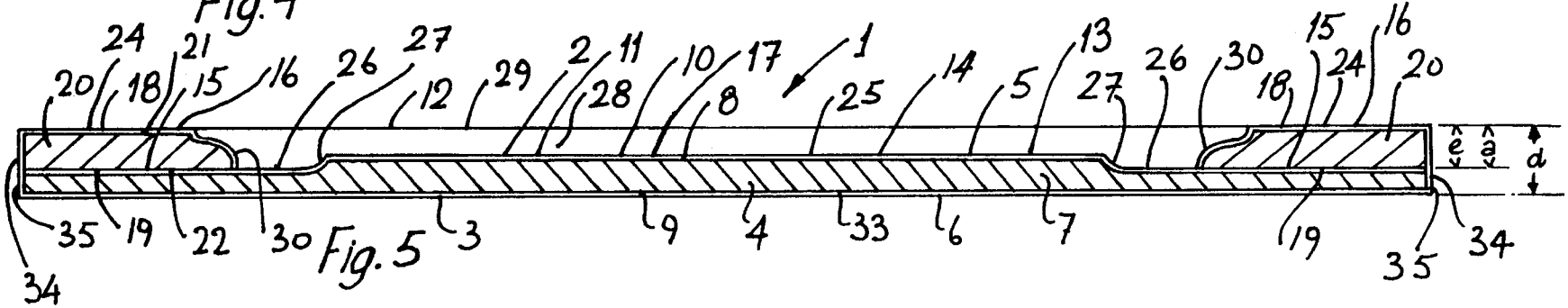
Figure 6:
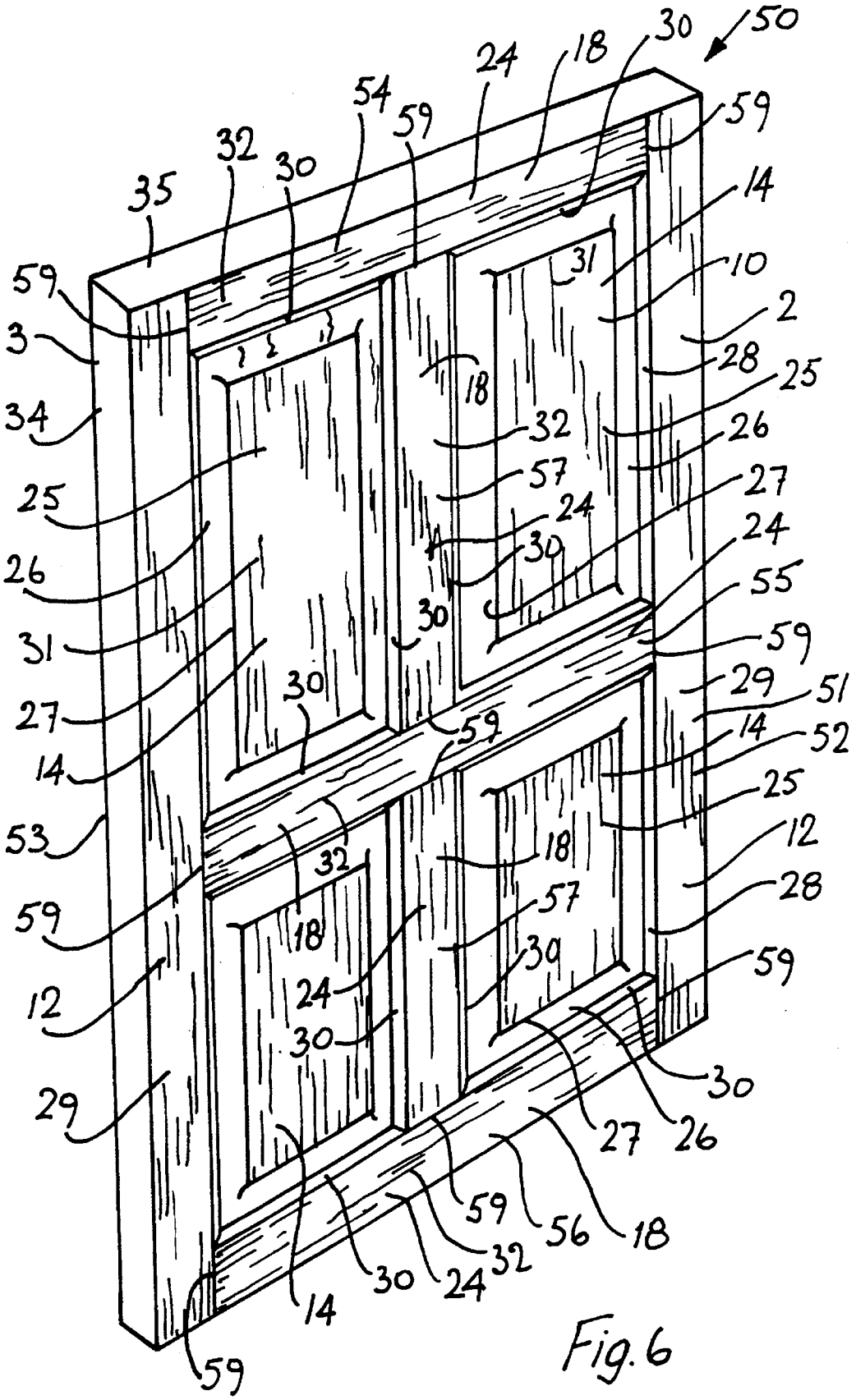
Figure 7:
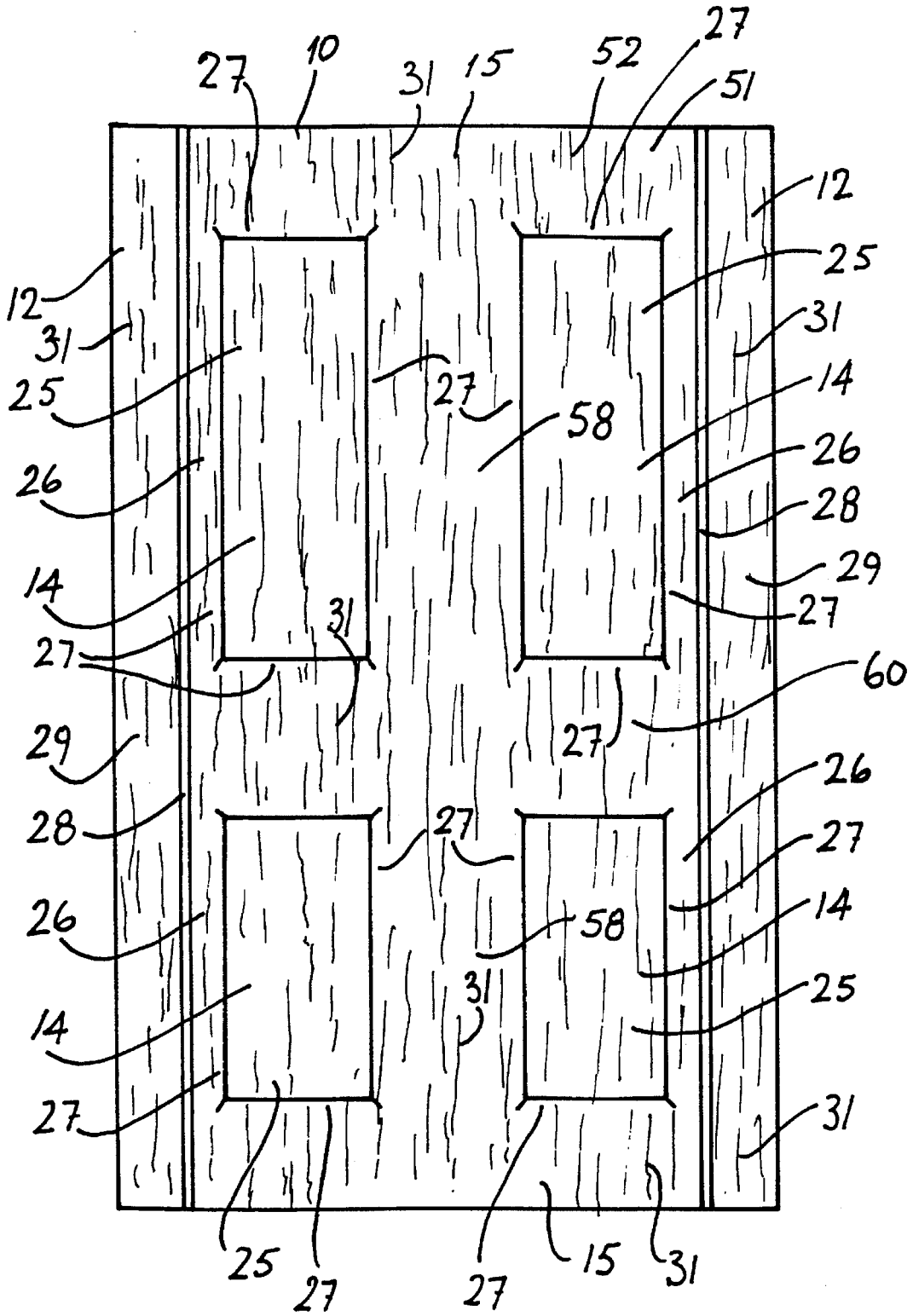
Figure 8:
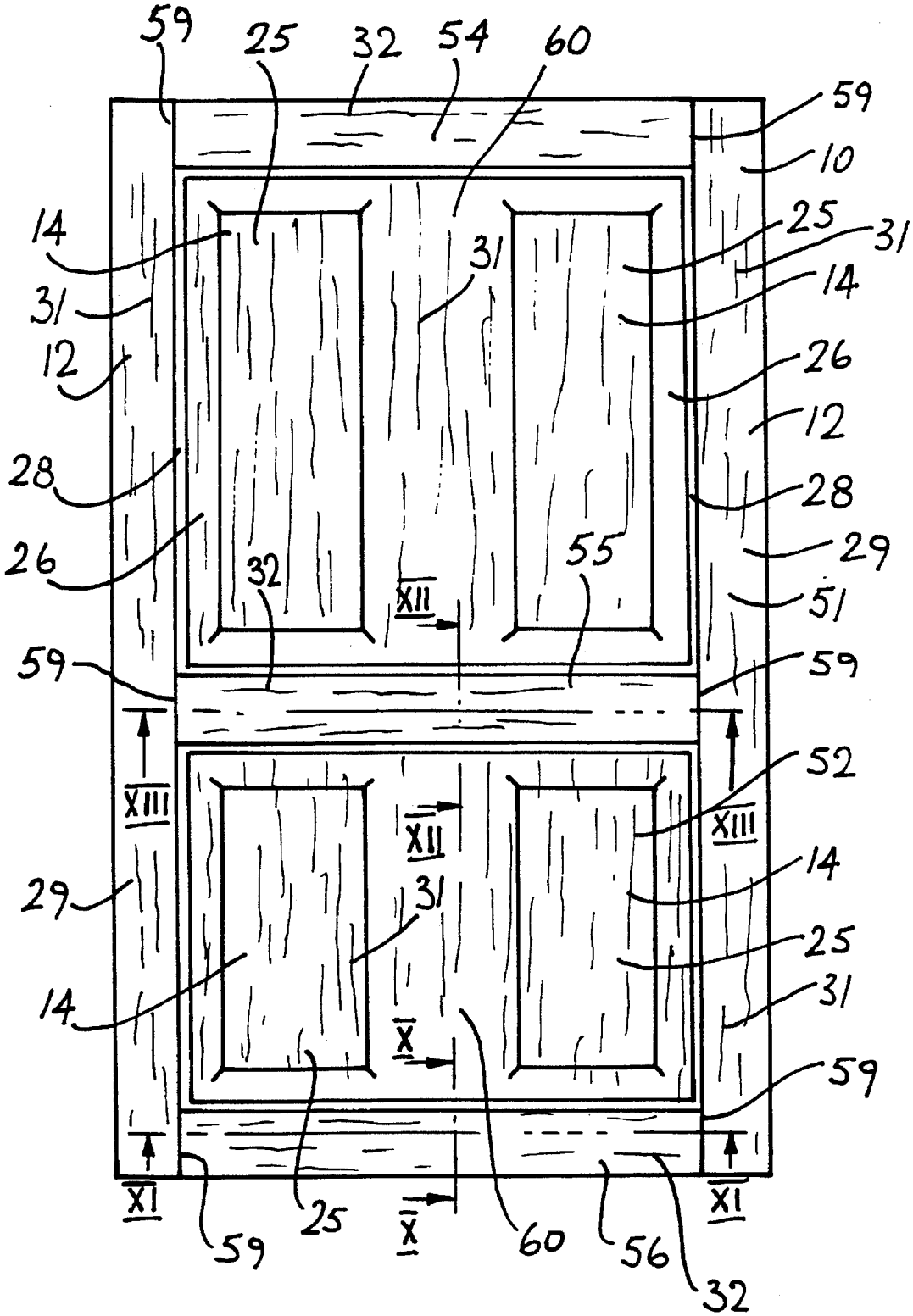
Figures 9, 10, 11, 12, 13, 14:
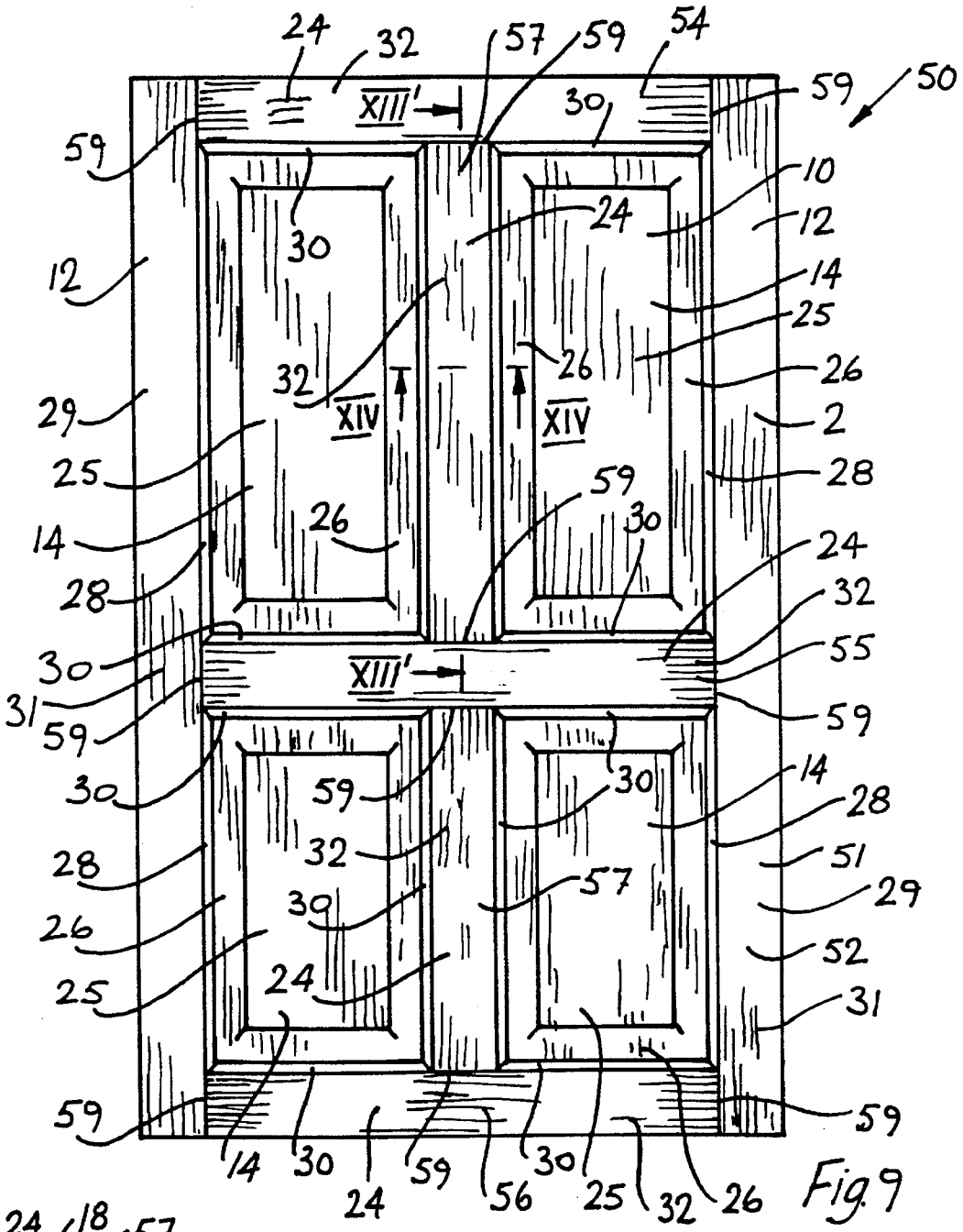

FIG. 3 is a cross-sectional end elevational view of the panel of FIG. 1 on the line III—III of FIG. 1, FIG. 4 is a cross-sectional end elevational view of the panel of FIG. 1 on the line IV—IV of FIG. 1, FIG. 5 is a cross-sectional side elevational view of the panel of FIG. 1 on the line V—V of FIG. 1, FIG. 6 is a perspective view of a panel according to another embodiment of the invention, FIG. 7 is a plan view of portion of the panel of FIG. 6, FIG. 8 is a plan view similar to FIG. 7 of the panel of FIG. 6 under construction, FIG. 9 is a plan view of the panel of FIG. 6, FIG. 10 is a cross-sectional end view of portion of the panel of FIG. 6 on the line X—X of FIG. 8, FIG. 11 is a cross-sectional side view of the portion of FIG. 10 on the line XI—XI of FIG. 8, FIG. 12 is a cross-sectional end view of another portion of the panel of FIG. 6 on the line XII—XII of FIG. 8, FIG. 13 is a cross-sectional side view of the portion of FIG. 12 on the line XIII—XIII of FIG. 8, and FIG. 14 is a cross-sectional end view of another portion of the panel of FIG. 6 on the line XIV—XIV of FIG. 9.

Referring to the drawings, and initially to FIGS. 1 to 5 thereof, there is illustrated a panel according to the invention indicated generally by the reference numeral 1 of wood. The panel 1 has a first major surface and a second opposite major surface which for convenience are hereinafter referred to as a front surface 2 and a rear surface 3, respectively. The front surface 2 is formed and shaped to simulate a framed-up panel, and the rear surface 3 is planar. The framed-up panel 1 is suitable typically as a door for a cabinet or cupboard, or as a panel for a coffin, wall, ceiling or the like. The panel 1 is formed from a main panel member 4 having front and rear surfaces 5 and 6, respectively, corresponding to the front and rear surfaces 2 and 3, respectively, of the panel 1. The main panel member 4 comprises a main substrate 7 having front and rear faces 8 and 9 and a main veneer sheet 10 laminated to the front face 8 of the main substrate 7 to form the front surface 5 of the main panel member 4. The front surface 5 of the main panel 4 is shaped by forming an elongated trough shaped recess 11 in the front surface 5 extending longitudinally from end to end of the main panel member 4 to form on the front surface 5 two spaced apart stiles 12. The recess 11 defines a base 13 which forms an infill panel 14 extending between the stiles 12 and two rail receiving surfaces 15 extending between the stiles at opposite ends of the infill panel 14 for receiving a pair of spaced apart rails 16 which extend between and join the stiles 12. Opposite side walls 17 of the recess 11 extend from the base 13 and form longitudinally extending side edge surfaces 28 of the respective stiles 12. Each rail 16 has first and second opposite major surfaces which for convenience are hereinafter referred to as outer and inner surfaces 18 and 19, respectively. Each rail 16 comprises a secondary substrate 20 having a first face 21 and a second face 22. A secondary veneer sheet 24 is laminated to the first face 21 of the secondary substrate 20 of each rail 16 to form the outer surface 18. The infill panel 14 is a raised infill panel and defines a raised central surface 25 and a lower surface 26 extending around the periphery of the central surface 25 adjacent the stiles 12 and rails 16. The lower surface 26 is co-planar with the rail receiving surfaces 15. A profiled step 27 extends around the periphery of the raised central surface 25 between the central surface 25 and the lower surface 26. The side edge surface 28 of each stile 12 adjacent the infill panel 14 is shaped to form a transverse convex curved profile which extends longitudinally along each stile 12 and joins a front surface 29 of the stile 12 to the lower surface 26 of the infill panel 14. A longitudinally extending side edge surface 30 extends along each rail 16 adjacent the infill panel 14 and is shaped to form a transverse convex curved profile which extends longitudinally along each rail 14 and joins the outer surface 18 of the rail 16 to the lower surface 26 of the infill panel 14.

The main substrate 7 and the secondary substrates 20 are of chipboard material, and the main veneer sheet 10 and secondary veneer sheets 24 are of a hardwood material, typically oak or mahogany and are generally matched prior to laminating to the respective main and secondary substrates 7 and 20, respectively. The main veneer sheet 10 is laminated to the main substrate 7 so that the grain pattern 31 of the main veneer sheet 10 runs substantially parallel to the stiles 12. The secondary veneer sheets 24 are laminated to the respective secondary substrates 20 so that the grain pattern 32 of the secondary veneer sheets 24 runs substantially parallel to the rails 16. A backing veneer sheet 33 of any suitable veneer material, timber or foil is laminated to the rear face 9 of the main substrate 7 to form the planar rear surface 3 of the panel 1. An edging strip 34 of foil is laminated to and extends around the peripheral side edge surface 35 of the panel 1.

A method according to the invention for producing the panel 1 will now be described. A sheet of chipboard material is cut to size to form the main substrate 7 of the main panel member 4. The front face 8 of the main substrate 7 is shaped by machining using a routing tool to form a rough outline of the recess 11 for forming the stiles 12 and the infill panel 14 as well as the rail receiving surfaces 15. Provided the material of the main substrate 7 is a relatively yielding type material, it is not essential that the front face 8 of the main substrate 7 should be machined to closely and accurately define the shape of the stiles 12, infill panel 14 and the rail receiving surfaces 15 of the front surface 5 of the main panel member 4. On the front face 8 of the main substrate 7 having been shaped, the main veneer sheet 10 is laminated to the front face 8 of the main substrate 7 using a compression moulding and laminating process. The main substrate 7 or the main veneer sheet 10 is coated with a suitable adhesive which may be a liquid or film type adhesive, and the main substrate 7 with the main veneer sheet 10 placed over the front face 8 is placed in a compression moulding press. A moulding die defining the shape of the front surface 5 of the main panel member 4 is brought into engagement with the main veneer sheet 10 to form the final shape of the front surface 5 of the main panel member 4. Appropriate pressure is applied to the die for bonding the main veneer sheet 10 to the main substrate 7 and for moulding the main veneer sheet 10 into the desired shape to form the front surface 5 of the main panel member 4. The die and base of the compression moulding press are generally heated. The temperature and pressure to which the main substrate 7 and the main veneer sheet 10 are subjected during lamination are a function of the adhesive used, and may also be a function of the substrate and veneer sheet. Typically the temperature and pressure are 50° C. to 150° C. and 4 bar to 10 bar, respectively. The backing veneer sheet 33 is then laminated to the rear face 9 of the main substrate 7 or may be laminated to the main substrate 7 during lamination of the main veneer sheet 10 as desired using a similar laminating process.

The rails 16 are each cut from an elongated rail which is prior formed. An elongated batten of chipboard of length sufficient to form many rails 16 and which forms the secondary substrates 20 of the rails 16 is first shaped by machining to provide the first face 21 and the second planar face 22. A side edge surface which corresponds to the side edge surface 30 of each rail 16 adjacent the infill panel 14 is machined to form a rough outline of the side edge profile surface 30 of each rail 16. An elongated secondary veneer sheet of length sufficient to form many rails 16 is laminated to the secondary substrate 20 in similar fashion as the main veneer sheet 10 is laminated to the main substrate 7. The secondary veneer sheet 24 extends over the entire first face 21 and the side edge surface of the secondary substrate 20 which corresponds to the side edge surface 30 of the rail 16. The final desired shape of the outer surface 18 and the side edge profile surface 30 of the rails 16 is formed during lamination by, for example, compression moulding. The rails 16 of the desired length are then cut from the laminate of secondary substrate 20 and secondary veneer sheet 24. Ends 37 of each rail 16 are shaped to accommodate the side edge profile surfaces 28 of the respective stiles 12. The shaping of the ends 37 is typically carried out by machining. The rail receiving surfaces 15 and side edge surfaces 29 of the stiles 12 adjacent the rail receiving surfaces 15 are coated with an adhesive. The rails 16 are placed on the adhesive coating with the inner surface 19 of the respective rails 16 engaging the adhesive. The shaped ends 37 of the rails 16 engage the adhesive coating on the side edge surfaces 29 of the stiles 12. The assembled main panel member 4 with the rails 16 in place, is placed in a suitable press and pressure is applied to the rails 16 for bonding the rails 16 to the main panel member 4. In this way the second face 22 of the secondary substrates 20 of the rails 16 are bonded directly to the main veneer sheet 10 of the main panel member 4. A typical pressure applied by the press for bonding the rails 16 to the main panel member 4 is of the order of 5 bar to 10 bar. Suitable adhesives for bonding the rails 16 to the main panel member 4 are polyvinyl acetate adhesive, urea formaldehyde adhesives and the like. The edging strip 34 is bonded to the peripheral side edge surface 35 using conventional bonding methods.

It has been found that by producing a panel using the method according to the invention, depths a between the front surface 5 of the infill panel 14, adjacent the stiles 12 and rails 16, namely, the lower surface 26 of the infill panel 14, and the front surface 5 of the stiles 12 and the outer surface 18 of the rails 16 of up to 18 mm can be achieved.

The method is particularly suitable for producing panels in which the depth a between the lower surface 26 of the infill panel 14 and the front surface 5 of the stiles and the outer surface 18 of the rails 16 is in the range of 5 mm to 18 mm, and in particular, where the depth a is in the range of 10 mm to 12 mm. Indeed, in theory there is no limit to the depth a between the lower surface 26 of the infill panel 14 and the co-planar surfaces 28 and 18 of the stiles 12 and rails 16, respectively. In general, it is envisaged that the depth a will be in the range of 30% to 70% of the maximum thickness d of the main panel member 4 from the front surface 5 to the rear surface 6 of the main panel 4 at the stiles 12. Accordingly, since in general, it is envisaged that the rail receiving surfaces 15 will be co-planar with the lower surface 26 of the infill panel 14, the thickness e of the rails 16 including the secondary substrate 20 and the secondary veneer sheet 24 will be in the order of 30% to 70% of the maximum thickness d of the main panel member 4. Needless to say, where the rail receiving surfaces 15 are co-planar with the lower surface 26 of the infill panel 14, the thickness e of the rails 16 will be similar to the depth a between the outer surface of the rails 16 and the lower surface 26 of the infill panel 14. For example, where the depth a is 10 mm the thickness e will likewise be 10 mm.

Referring now to FIGS. 6 to 14 there is illustrated a panel 50 according to another embodiment of the invention which in this case is suitable for forming one face of an apartment door. An apartment door would in practice be formed from two such panels 50 which would be laminated together to form respective front and rear faces of the apartment door, or may be laminated to a third intermediate panel of low grade timber or heat insulating material, or to an intermediate frame. The panel 50 is manufactured according to a method similar to that described for manufacturing the panel 1, and furthermore, the panel 50 is somewhat similar to the panel 1 and similar components are identified by the same reference numerals. The main difference between the panel 50 and the panel 1 is that four infill panels 14 are provided in the panel 50. The panel 50 comprises a main panel member 51 of similar construction to the main panel member 4 of the panel 1. The main panel member 51 has a front surface 52 corresponding to the front surface 2 of the panel 50 which would form one of the faces of the apartment door. The main panel member 51 has a planar rear surface 53 corresponding to the rear surface 3 of the panel 50, which in practice is laminated to a corresponding surface of another panel 50 to form the other face of the apartment door. The front surface 52 of the main panel member 51 is shaped by forming the recess 11 which defines a pair of stiles 12 and forms four raised type infill panels 14. An intermediate rail receiving surface 60 is defined between adjacent infill panels 14 for receiving an intermediate rail 55, and two intermediate stile receiving surfaces 58 are defined between adjacent infill panels 14 for receiving intermediate stiles 57 as will be described below. The intermediate rail receiving surface 60 and the intermediate stile receiving surfaces 58 are co-planar with the rail receiving surfaces 15 and the lower surfaces 26 of the infill panels 14. The main panel member 51 is formed and shaped by a similar method as that used in forming and shaping as the main panel member 4 of the panel 1 and comprises a main substrate 7 laminated with a main veneer sheet 10 and a backing veneer sheet 33. Although in many cases where the rear surfaces will not be exposed in use the backing veneer sheet 33 may be omitted.

Three spaced apart rails, namely, a top rail 54, and a bottom rail 56 and the intermediate rail 55 which are of substantially similar construction to the rails 16 of the panel 1 are bonded to the rail receiving surfaces 15 and the intermediate rail receiving surface 60 of the main panel member 51 and extend between the stiles 12. The intermediate stiles 57 extend longitudinally of the main panel member 51 between and parallel to and spaced apart from the stiles 12 and join the rails 54, 55 and 56. The intermediate stiles 57 are bonded to the stile receiving surfaces 58 which are similar to the rail receiving surfaces 15 and are co-planar with the rail receiving surfaces 15 and lower surfaces 26 of the infill panels 14. The stiles 12, rails 54, 55 and 56 and the intermediate stiles 57 extend around the infill panels 14.

The rails 54, 55 and 56 are formed in similar fashion as the rails 16 of the panel 1 and each comprises a secondary substrate 20 laminated with a secondary veneer sheet 24. The only difference being that the intermediate rail 56 is formed with a pair of side edge surface profiles 30.

The intermediate stiles 57 are formed in substantially similar fashion as the rails 16 from a secondary substrate 20 laminated with a secondary veneer sheet 24. Ends 59 of the rails 54, 55 and 56 and of the intermediate stiles 57 are shaped to accommodate adjacent side edge surface profiles 29 and 30 of the stiles 12 and rails 54, 55 and 56, respectively, against which the ends 59 abutt.

The method for producing the panel 50 is as follows. The main panel member 51 is provided by cutting a sheet of suitable material to size to form the main substrate 7. Typically, chipboard or other suitable low cost timber or a board made from other waste wood material. A rough outline of the recess 11 to form a rough outline of the front surface 52 of the main panel member 51 is machined in the front face 8 of the main substrate 7 so that the outline of the stiles 12, the infill panels 14 and the rail and stile receiving surfaces is formed. The main veneer sheet 10 of hardwood with the grain pattern 31 running parallel to the stiles 12 is then laminated to the front surface 8 of the main substrate 7 in a compression moulding press where the main veneer sheet 10 is shaped and formed to form the front surface 52 of the main panel member 51. After lamination of the main veneer sheet 10 to the main substrate 7 or simultaneously therewith, the backing veneer sheet 33, should this be required, is laminated to the rear face 9 of the main substrate 7. The rails 54, 55 and 56 and the intermediate stiles 57 are formed in similar fashion to the rails 16 of the panel 1 and are bonded to the respective rail receiving surfaces 15 and the stile receiving surfaces 58 in similar fashion as the rails 16 are bonded to the rail receiving surface 15 of the main panel member 4 of the panel 1. The grain pattern of the secondary veneer sheets 24 is arranged to run parallel to the rails 54 and 56 and the intermediate rail 55 and stiles 57. Although not illustrated, the ends 59 of the intermediate stiles 57 are identical to the ends 59 of the intermediate rail 55. A cross-sectional view of the intermediate stile 57 on the line XIII'—XIII' of FIG. 9 would be substantially identical to the cross-sectional view of the intermediate rail 55 on the line XIII—XIII illustrated in FIG. 13. The edge veneer strip 34 is laminated to the side edge surface 35 of the panel 50.

Should it be desired to form an apartment door from a single panel, the main panel member would be formed from a main substrate of sufficient thickness corresponding to the desired thickness of the apartment door. The front and rear surfaces 2 and 3 of the panel 50 would each be shaped in the form of framed-up panels. Thus, the main panel member 51 would be formed with identical front and rear surfaces 52 and 53 and main veneer sheets 10 would be laminated to both the front and rear faces 8 and 9, respectively of the main substrate 7. Rails 54, 55 and 56 and intermediate stiles 57 would be laminated to the front and rear surfaces 52 and 53 of the main panel member 51.

While the panels according to the invention have been described as having a front surface shaped to form a framed-up panel suitable for use as a door for a cupboard, an apartment door or the like, it will be appreciated that the panel according to the invention may be provided for many other purposes.

It is envisaged that the rails need not extend perpendicularly to the stiles, but rather, may be at any angle or angles to the stiles.

It is also envisaged that the infill panel may be of other shape, and where the infill panel is provided with a raised surface having at least two opposite edges curved, it is envisaged that the rails or stiles adjacent the curved edges of the raised surface of the infill panel may be similarly shaped. Additionally, it is envisaged that the infill panel may be of hexagonal, octagonal or other desired shapes, and in which case, the rails extending between the stiles would be appropriately formed and located. It is also envisaged that the rail or rails adjacent the top of an infill panel may be arched or arranged to form an arch.

While in the case of the panel of FIGS. 1 to 5 the method for producing the panel has been described for producing a single panel only, it is envisaged that the method for producing the panel may be such as to enable a plurality of main substrates laminated with the main veneer sheets to be formed for a plurality of panels from one continuous sheet of chipboard or other substrate material. In which case, where the continuous sheet of substrate has been machined and laminated the laminated sheet would then be cut to form respective main panel members for respective panels.

Additionally, if desired the rails may be individually formed from a short length of secondary substrate and secondary veneer sheet.

It will of course be appreciated that while the panels have been described as being formed by main and secondary substrates of chipboard, substrates of any other material may be provided, for example, high density, medium density or low density fibre board, low grade wood, reconstituted wood, oriented strand board, composite material panels, plastics materials, heat insulation materials, metals or any other desired or suitable substrate material.

Indeed, in certain cases, it is envisaged that the main and/or secondary veneer sheets may be of a plastics material, foils, or the like which may or may not simulate a wood finish, and may or may not be provided with a grain. Needless to say, a veneer sheet of any other suitable or desired material may be used. It is also envisaged that edging strips of material other than foil may be used, and indeed, in certain cases, it is envisaged that the edging strip may be a wood veneer, or indeed, may be a strip of wood, or plastics material, or any other suitable material.

It is also envisaged that each rail may be formed from a solid batten of hard or soft wood.

While in the method for laminating the veneer sheets to the substrates and for securing the rails to the main panel member, a press comprising a die has been used, it is envisaged that a membrane press may be used, and needless to say, any other suitable press system may be used.

It is envisaged in many cases that the main veneer sheet may not extend fully over the rail and stile receiving surfaces beneath the rails, intermediate rail and intermediate stiles. In such cases the main veneer sheet may terminate adjacent the side edge surface profile of the relevant rail or stile, or may extend just beneath the rail or stile adjacent the side edge surface profile. The secondary substrate of the rails, intermediate rails or stiles would then be effectively laminated directly onto the main substrate.

While a rough outline of the stiles and infill panel has been described as being formed in the main substrate by machining using a routing tool, outline of the stiles and infill panel may be formed in the main substrate using any other suitable machining, or any other forming or shaping means, for example, moulding, extrusion, or the like. It is also envisaged that in many cases it may not be necessary to form or machine a rough outline of the stiles and infill panel on the main substrate, in which case, the stiles and infill panel would be formed in the front surface of the main panel member by compression moulding during lamination of the main veneer sheet to the main substrate. This would be possible in cases where the main substrate is provided by a sheet of material of relatively low density, such as, for example, low density chipboard, fibreboard and the like.

While the panel suitable for forming an apartment door has been described as having four infill panels, panels with any number of infill panels may be provided, and in certain cases, it is envisaged that a number of parallel intermediate stiles may be provided intermediate the stiles, and it is also envisaged that a number of intermediate rails may be provided intermediate the rails.

What is claimed is:

1. A method for producing a panel (1,50) having first and second opposite major surfaces (2,3), the first major surface (2) simulating a framed-up panel of the type comprising an infill panel (14) and a pair of spaced apart stiles (12) joined by a pair of spaced apart rails (16, 54, 56) which together extend around the infill panel (14), the method comprising the steps of providing a main panel member (4,51) having first and second opposite major surfaces (5, 6, 52, 53) corresponding respectively to the first and second surfaces (2, 3) of the panel (1), the main panel member (4, 51) being formed from a main substrate (7) having first and second opposite major faces (8, 9), and a main veneer sheet (10) laminated to the first face (8) of the main substrate (7) for forming the first surface (5,52) of the main panel member (4,51), shaping the first surface (5,52) of the main panel member (4,51) to simulate the pair of spaced apart elongated stiles (12) and the infill panel (14) extending between the stiles (12), characterized in that the first surface is shaped to define two spaced apart rail receiving surfaces (15) extending between the stiles (12) adjacent respective opposite ends of the infill panel (14), and two spaced apart elongated rails (16) are secured to the respective rail receiving surfaces (15), the rails (16) extending between and joining the stiles (12).

2. A method as claimed in claim 1 characterised in that the first surface (5,52) of the main panel member (4,51) is shaped by forming an elongated trough shaped recess (11) in the first surface (5,52) extending longitudinally from end to end of the main panel member (4,51), the recess (11) defining a base (13) which forms the infill panel (14) and the rail receiving surfaces (15), and the recess (11) defining opposite side walls (17) extending from the base (13) which form respective side edge surfaces (28) of the stiles (12).

3. A method as claimed in claim 2, characterised in that portion (25) of the base (13) of the recess (11) is raised or lowered to form an infill panel (14) of corresponding shape.

4. A method as claimed in claim 1 characterised in that the main veneer sheet (10) has a longitudinally extending grain pattern (31), and the main veneer sheet (10) is laminated to the main substrate (7) with the grain pattern (31) extending parallel to the stiles (12).

5. A method as claimed in claim 1 characterised in that each rail (16) has first and second opposite major surfaces (18,19), the first surface (18) corresponding to the first surface (2) of the panel (1,50), and the second surface (19) being secured to the corresponding rail receiving surface (15) of the main panel member (4,51), the method further comprising the steps of forming each rail (16) by providing a secondary substrate (20) having first and second opposite major faces (21,22), and laminating a secondary veneer sheet (24) to the first face (21) of the secondary substrate (20) for forming the first surface (18) of the rail (16).

6. A method as claimed in claim 5 characterised in that the secondary veneer sheet (24) of each rail (16) has a longitudinally extending grain pattern (32), the secondary veneer sheets (24) being laminated to the respective secondary substrates (20) with the grain pattern (32) extending substantially parallel to the respective rails (16).

7. A method as claimed in claim 1 characterised in that the main substrate (7) is a one piece substrate formed from a single sheet of material, and the first face (8) of the main substrate (7) is shaped to form a rough outline of the first surface (5,52) of the main panel member (4,51).

8. A method as claimed in claim 7 characterised in that the main veneer sheet (10) is laminated to the main substrate (7) after the first face (8) of the main substrate (7) has been shaped.

9. A method as claimed in claim 1 characterised in that the main veneer sheet (10) covers the entire first face (8) of the main substrate (7).

10. A method as claimed in claim 1 characterised by forming the main veneer sheet (10) from a single sheet of veneer.

11. A method as claimed in claim 1 characterised by forming each rail receiving surface (15) so as to be co-planar with an adjacent portion of the infill panel surface (26).

12. A method as claimed in claim 1 characterized by forming the main and secondary substrates (7,20) of one of similar and different materials, and materials forming the main and secondary substrates (7,20) selected from the group consisting of a wood, a reconstituted wood, a softwood, a hardwood, a chipboard, an oriented strand board, a high, medium or low density fibre board, and a composite material panel, and forming the main and secondary veneer sheets (10,28) of one of similar or different veneer materials said veneer materials selected from the group consisting of:

a hardwood timber veneer sheet, a softwood timber veneer sheet, a synthetic foil, a plastic veneer sheet without a grain, a plastic veneer sheet with a grain, and a decorative veneer sheet.

13. A panel having first and second opposite major surfaces (2, 3), the first major surface (2) simulating a framed-up panel of the type comprising an infill panel (14) and a pair of spaced apart stiles (12) joined by a pair of spaced apart rails (16) which together extend around the infill panel (14), the panel (1, 50) comprising a main panel member (4, 51) having first and second opposite major surfaces (5, 6, 52, 53) corresponding respectively to the first and second surfaces (2, 3) of the panel (1, 50), the main panel member (4, 51) being formed from a main substrate (7) having first and second opposite major faces (8, 9), and a main veneer sheet (10) laminated to the first face (8) of the main substrate (7) for forming the first surface (5, 52) of the main panel member (4,51), the first surface (8) of the main panel member being shaped to simulate the pair of spaced apart elongated stiles (12) and the infill panel (14) extending between the stiles (12), characterised in that the first surface (8) is shaped to define two spaced apart rail receiving surfaces (15) extending between the stiles (12) adjacent respective opposite ends of the infill panel (14), and two spaced apart elongated rails (16) are secured to the respective rail receiving surfaces (15), the rails (16) extending between and joining the stiles (12).

14. A panel as claimed in claim 13 characterised in that the first surface (5,52) of the main panel member (4,51) is shaped by the formation of an elongated trough shaped recess (11) in the first surface (5,52) extending longitudinally from end to end of the main panel member (4,51), the recess (11) defining a base (13) which forms the infill panel (14) and the rail receiving surfaces (15), and the recess (11) defining opposite side walls (17) extending from the base (13) which form respective side edge surfaces (28) of the stiles (12).

15. A panel as claimed in claim 14 characterised in that portion (25) of the base (13) of the recess (11) is raised or lowered to form the infill panel (14) of corresponding shape.

16. A panel as claimed in claim 13 characterised in that the main veneer sheet (10) is provided with a longitudinally extending grain pattern (31) which extends substantially parallel to the stiles (12).

17. A panel as claimed in claim 13 characterised in that each rail (16) has first and second opposite major surfaces (18,19), the first major surface (18) corresponding to the first surface (2) of the panel (1,50), the second major surface (3) being secured to the corresponding rail receiving surface (15) of the main panel member (4,51), each rail (16) comprising a secondary substrate (20) having first and second opposite major faces (21,22) corresponding to the first and second surfaces (18,19) of the rail (16), and a secondary veneer sheet (24) laminated to the first face (21) of the secondary substrate (20) for forming the first surface (18) of the rail (16).

18. A panel as claimed in claim 17 characterised in that the secondary veneer sheet (24) of each rail (16) is provided with a longitudinally extending grain pattern (32), which extends substantially parallel to the rail (16).

19. A panel as claimed in claim 13 characterised in that the main substrate (7) is a one piece substrate formed from a single sheet of material.

20. A panel as claimed in claim 13 characterised in that the main veneer sheet (10) covers the entire first face (10) of the main substrate (7).

21. A panel as claimed in claim 13 characterised in that the main veneer sheet (10) is formed from a single sheet or veneer.

22. A panel as claimed in claim 13 characterised in that each rail receiving surface (16) is substantially co-planar with an adjacent portion (26) of the infill panel surface.

23. A panel as claimed in claim 13 characterised in that the main and secondary substrates (7,20) may be of similar or different materials, and may be selected from any one or more of the following materials:

any suitable wood or reconstituted wood, softwood, hardwood, chipboard, oriented strand board, high density, medium or low density fibre board, and any composite material, and the main and secondary veneer sheets (10,34) may be similar or different and may be matched or otherwise and may be selected from any one or more of the following types of veneer sheets:

timber veneer sheet of hardwood or softwood, synthetic foil, veneer sheet of plastics material which may or may not simulate a grain, decorative veneer sheet, and any other suitable veneer sheet.

* * * * *